United States Patent [19]

Miller

[11] 4,361,972

[45] Dec. 7, 1982

[54] RIDER'S SHOE

[76] Inventor: Lawrence Miller, 299 NE. 28th St., Boca Raton, Fla. 33431

[21] Appl. No.: 289,053

[22] Filed: Jul. 31, 1981

[51] Int. Cl.[3] ..... A43B 5/00

[52] U.S. Cl. ..... 36/131

[58] Field of Search ..... 36/131, 28, 29

[56] References Cited

U.S. PATENT DOCUMENTS 589,443 9/1977 Rathbun ..... 36/131
4,188,737 2/1980 Haver ..... 36/131
4,229,889 10/1980 Petrosky ..... 36/29
4,322,892 4/1982 Inohara ..... 36/29

*Primary Examiner*—Patrick D. Lawson
*Attorney, Agent, or Firm*—Charles H. Brown

[57] ABSTRACT

A pedal shoe particularly useful for use with bicycles lacking shoe pedal clips, comprising a relatively thick, high strength lower sole provided with a transverse cylindrical bore having such interior dimension as to accommodate the rotatable pedal shaft which is connected to the crank gear of the bicycle.

9 Claims, 6 Drawing Figures

RIDER'S SHOE

The present invention relates to shoes adapted for use with pedals used to drive a velocipede, particularly a bicycle, though not limited thereto.

In competitive bicycle racing, speed and time are important factors in determining the winner. In such races, the cyclist's shoes are securely fastened to the pedals by clips and belts to enable the rider to exert the greatest effort on the pedals during the downward and upward strokes of the driver's feet. The use of toe clips and belts on the driver's shoes inhibit prompt disengagement of the rider's feet from the bicycle, when such disengagement is most needed. In high speed racing, in the event of a crash, the use of toe clips and belts to securely attach the shoes to the pedals usually result in the rider falling with the bicycle and serious body injury to the cyclist. There are times when the bicycle tires require changing during a race. The secure attachment of the cyclist's shoes to the pedals prevents immediate detachment of the shoes from the bicycle during the tire change, as a result of which precious racing time is lost in the race.

The present invention is a shoe which overcomes the foregoing disadvantages. The shoe of the invention enables instant disengagement of the cyclist's feet from the pedals by mere side movements of the feet in a direction away from the bicycle, while still providing the needed pedal grip to achieve the greatest force (pull or push) on the pedals and crank during the downward and upward movement of the driver's foot when the crank arm is approaching or receding from its lowest vertical position. More particularly, the shoe of the invention is provided with a relatively thick lower sole of high strength, light weight material having one or more transverse cylindrical bores therein, with internal dimensions adequate to enable the pedal shaft or crank pin constituting the pedal axis to enter therein in close proximity to the bore walls but without any frictional binding between bore and pedal shaft. The lower sole may be provided with additional but incomplete transverse bores or cut-out portions near the heel and toe positions of the shoe in order to minimize the weight of the shoe.

A feature of the invention is the ridge or backbone of lower sole material which is provided at the bottom surface of the lower sole to enable the rider to walk on the shoe after dismounting from the bicycle. Another feature of the shoe of the invention is the aerodynamically-shaped water-proof flap or tongue at the front of the shoe extending from the toe area to a point above the shoe lacing to prevent water from running over the foot and to facilitate the flow of water towards the sides of the shoe. Preferably, easily separated velcro material is provided on both sides of the shoe below the lacing area and also on the inside of the flap or tongue to detachably attach the flap to the shoe during use thereof.

A more detailed description of the invention follows in conjunction with drawings, wherein FIG. 1 is a perspective view of the shoe of the invention;

Figure 4:
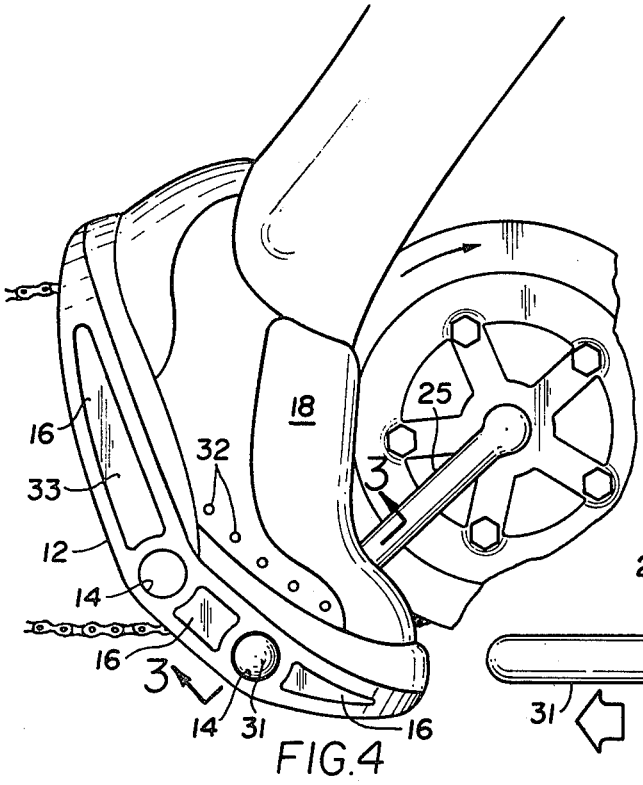
Figure 6:
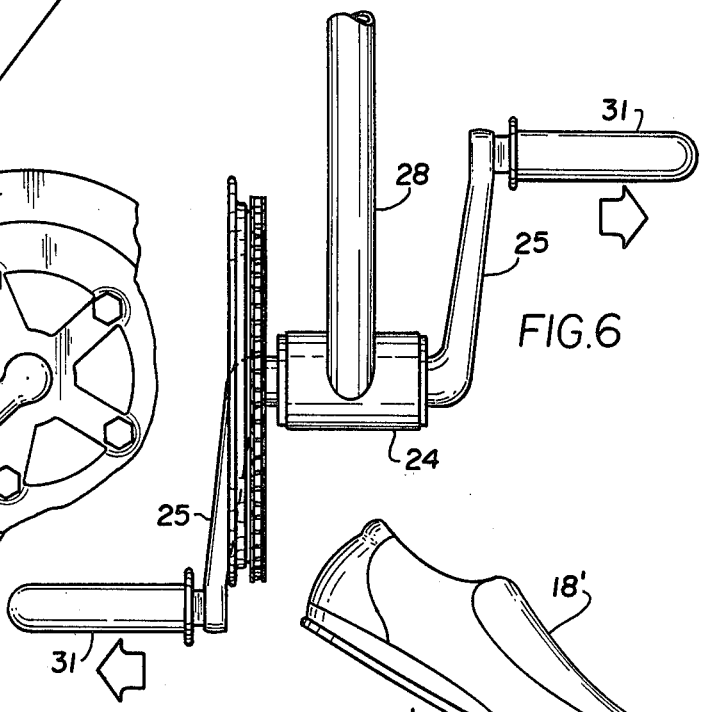
Figure 5:
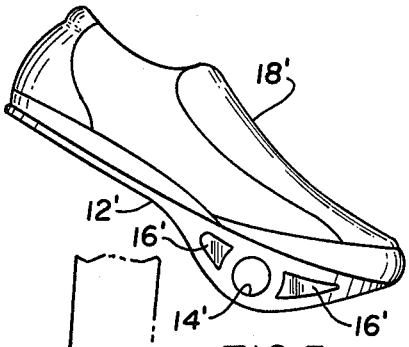

FIG. 4 is a partial perspective view of one foot of the cyclist wearing the shoe of the invention when it is connected to the bicycle crank gear; and FIG. 5 is a modification of the shoe of the invention, showing a tapered or size-reduced cut-down area of the heel portion of the shoe in order to minimize the weight of the shoe; and FIG. 6 shows the two crank pedal shafts on opposite sides of bicycle connected to the gear housing and the frame.

Throughout the various figures of the drawing, the same parts are represented by like reference numerals.

The shoe of the invention comprises a cast light weight sole plate 10 of magnesium or aluminum alloy, a relatively thick but resilient lower sole 12 having cylindrical transverse bores 14 passing preferably completely through the sides of the sole 12 and of an interior diameter to enable easy insertion of a pedal shaft, crank pin or pedal axis 26. The lower sole 12 is made of high strength, light-weight material. It can be of resilient materials and self-lubricating to enable easy rotation of the pedal shaft 26 within close proximity to the walls of the transverse bores 14. The lower sole 12 can, for example, be made of nylon or other suitable plastic material which can be molded. One transverse bore 14 should be located under the ball of the foot while the other transverse bore can be suitably spaced away but parallel to the aforesaid one transverse bore to enable the rider to selectively shift the greatest force brought to bear on the pedal during upward and downward movements of the foot, merely by changing the position of the pedal shaft to the selected transverse bore. The incomplete transverse bores or cut-out portions 16 eliminate weight of the shoe and minimize the pressure needed to drive the bicycle.

The construction of the shoe enables foot power to be utilized during the entire 360 degree revolution of the crank, not solely on the downward motion of the foot.

A water resistant aerodynamically-shaped flap or tongue 18 extends from the toe portion of the shoe to an area above the lacing area to prevent water from running over the foot and to facilitate the flow of water towards the sides of the flap. Velcro strips 35 may be used to fasten the tongue 18 to the shoe. Padding 30 helps to protect the foot 37 from irritation; air vents 32 aid in ventilating the shoe.

The shoe enables easy disengagement of the cyclist's foot from the bicycle merely by a sideways movement of the foot away from the bicycle in the direction of the arrows as a result of which the shoe slides off the pedal shaft or crank pin 26. In this way, in the event of a crash, the cyclist can easily dismount thereby avoiding injury and avoid falling with the bicycle. Further, the simple disengagement of the shoe from the pedal enables easy replacement of tires during a race where time to complete a course is an important factor.

The transverse bores 14 are preferably provided with tapered ends 15 on the side into which the pedal shaft or crank pin 16 enters the bore in order to facilitate easy insertion of the shaft into the bore.

In FIG. 5, the rear portion of the bottom sole beyond the transverse bores is cut down, tapered, or removed in the interest of lightness while the shoe retains all the advantages of the invention.

FIG. 6 illustrates how the two pedal shafts on opposite side of bicycle connect to the gear housing 24 and the frame 28.

A contoured inner sole 20 rises on both side edges to provide arch support and prevent the foot from sliding forward during the downward stroke, thereby preventing toe discomfort. The contoured inner sole may be any suitable plastic material such as a light-weight nylon or a synthetic polymer. The lower sole 12 as well as the contoured inner sole 20 should be of light-weight and high strength and sufficiently resilient to return to their original shapes after foot pressure is removed.

Figure 2:
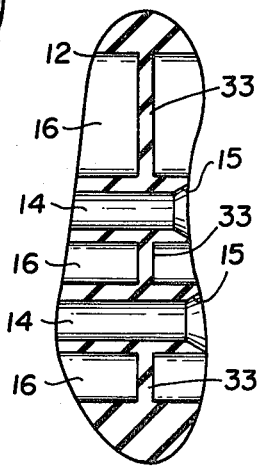
FIG. 2 is a sectional view of the shoe taken along line 2—2 of FIG. 1, which illustrates the use of ridge or back-bone material constituting the material of the lower sole and extending between transverse bores and cut-out portions to facilitate comfortable walking on the shoe.

To enable the rider to walk comfortably on the shoe after he dismounts from the bicycle a back-bone or ridge 33 of the sole material may extend along the center of the bottom surface of the lower sole as shown in FIG. 2.

Figure 3:
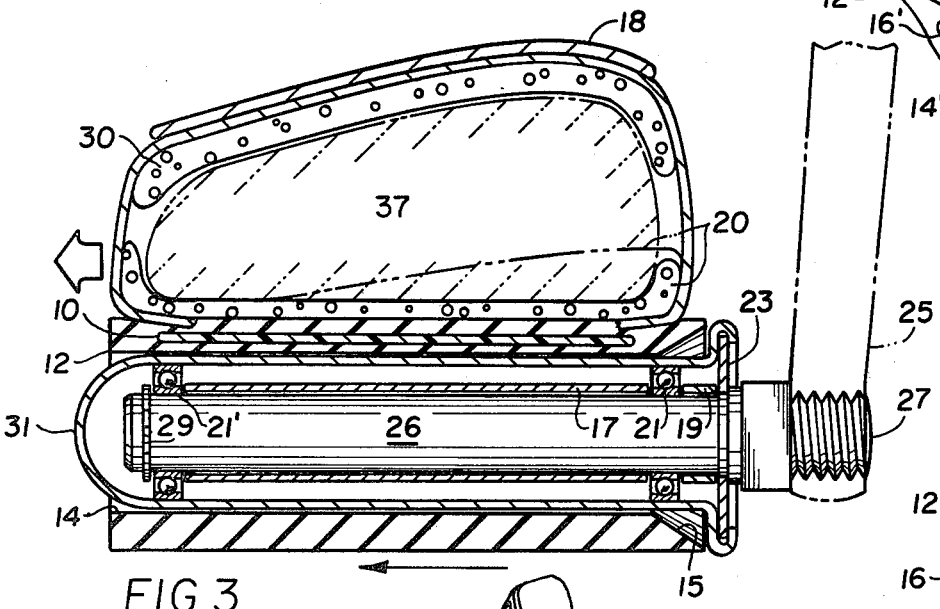
FIG. 3 is a vertical cross-section view or slice through the toe or ball area of the foot when the shoe is worn and the pedal shaft or crank pin axis of the bicycle is inserted within a transverse bore of the lower sole.
Figure 1:
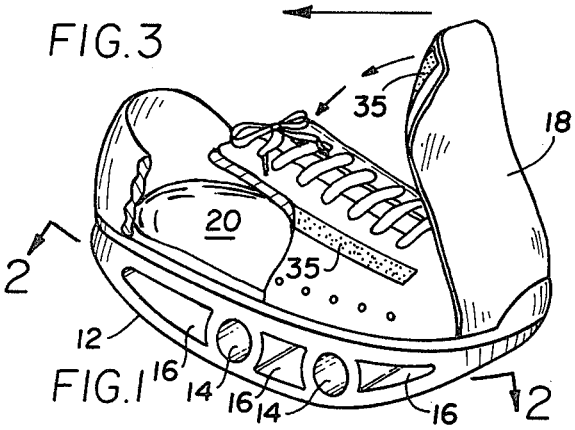

The pedal axis, shaft, or crank pin 26 shown in cross-section in FIG. 3 may be conventional. Large and small spacers 17 and 19, respectively are shown separated by ball bearings 21. A "C" ring 29 at the left holds the ball bearings 21 and 21 and spacers on the shaft. The small spacer 19 fits into a groove or shoulder on the free wheeling washer 23. The shaft 26 is screwed at 27 into the crank arm 25. A sleeve 31 encloses the rotatable shaft or crank pin 16.

In summation, the shoe of the invention by enabling fast and simple disengagement from the bicycle assures the maximum safety from injury to the rider; provides lightness in weight to reduce to a minimum the effort to drive the bicycle, comfortable walking after the cyclist dismounts from the bicycle, and provides ideal positive engagement to the crank arm for the entire 360 degree motion of the foot without the need for toe clips and straps on the pedals, thereby providing full utilization of foot muscle power.

It should be understood that the shoe of the invention is not limited to use on a bicycle but may have other applications; for example, for use with the stirrups on a horse if the stirrup is modified to enable rod insertion into the transverse bore.

What is claimed is:

1. A cyclist's shoe comprising a relatively thick, light-weight, lower sole of high strength material provided with a transverse bore, said bore being tapered on the side nearest to the arch of the rider and said bore having such interior dimension as to accommode the pedal shaft which is connected to the crank gear.

2. A shoe according to claim 1 wherein the transverse bore is located under area corresponding to the ball of the rider's foot and passes completely through the side of the lower sole.

3. A shoe according to claim 1 or 2 including another similar transverse bore through said lower sole but spaced from the parallel to said first bore to enable the rider to select the precise area under the foot to apply the greatest pressure upon the pedal.

4. A shoe according to claim 1 wherein the lower sole has, in addition to said transverse bore, other transverse bores, holes, or cut-outs which pass only partially through said lower sole for minimizing the total weight of the shoe.

5. A shoe as defined in claim 3 or 4 wherein there is provided a backbone or ridge between adjacent bores at the bottom surface of said lower sole to hereby enable the cyclist to walk on said shoe after it is disengaged from the pedal shaft of the bicycle and to prevent compression of said bores.

6. A shoe according to claim 1 which is provided with means for lacing the shoe, and also provided with an aerodynamically-shaped waterproof tongue extending from the toe area to above the lacing area on the exterior front of the shoe, said shoe having velcro on the sides below the lacing area and on the inside of the tongue on both side and inside portions of the tongue to enable the tongue to be attached to the shoe in water-tight relation to the lacing area during use of the bicycle.

7. A cyclist shoe especially for use with bicycles characterized by the absence of shoe pedal clips comprising a contoured inner sole and a thicker lower sole of high strength material provided with a transverse cyclindrical bore having such interior dimension as to accommodate the pedal shaft or axis which is connected to the crank gear, said lower sole having transverse cut-out portions to reduce the total weight of the shoe, the bottom of the lower sole being provided between bore and cut-out portions with a ridge or back-bone area to enable the cyclist to walk on the shoe after disengagement from the bicycle.

8. A shoe according to claim 7 in which the lower sole is of resilient material and of such high strength that it retains its shape when foot pressure is removed.

9. A rider's shoe comprising a relatively thick, light-weight, lower sole of high strength material provided with a completely cylindrical transverse bore which passes through both sides of said lower sole, said bore being tapered on the side nearest to the arch of the rider and said bore having such interior dimension as to accommodate a shaft.

* * * * *